United States Patent [19]

Johnson et al.

[11] Patent Number: 4,909,743

[45] Date of Patent: Mar. 20, 1990

[54] ELECTRICAL CONNECTOR

[75] Inventors: Lennart B. Johnson, Milford; Benjamin F. Kendig, Nashua, both of N.H.

[73] Assignee: Teradyne, Inc., Boston, Mass.

[21] Appl. No.: 257,852

[22] Filed: Oct. 14, 1988

[51] Int. Cl.[4] ..... H01R 23/68

[52] U.S. Cl. ..... 439/60; 439/81

[58] Field of Search ..... 439/59, 60, 61, 62, 439/63, 79, 80, 81, 83, 84, 629

[56] References Cited

U.S. PATENT DOCUMENTS

| | | | |
|---|---|---|---|
| 3,524,108 | 8/1970 | English | 439/82 |
| 4,150,863 | 4/1979 | Krafthefer et al. | 439/629 |
| 4,264,114 | 4/1981 | Chandler | 439/80 |
| 4,392,705 | 7/1983 | Andrews, Jr. et al. | 439/79 |
| 4,505,035 | 3/1985 | Burton et al. | 439/79 |
| 4,628,410 | 12/1986 | Goodman et al. | 439/83 |
| 4,631,637 | 12/1986 | Roman et al. | 439/61 X |
| 4,637,135 | 1/1987 | Grabbe | 439/83 |
| 4,655,518 | 4/1987 | Johnson et al. | 439/62 |
| 4,660,911 | 4/1987 | Reynolds et al. | 439/83 |

FOREIGN PATENT DOCUMENTS

| | | | |
|---|---|---|---|
| 866052 | 4/1961 | United Kingdom | 439/59 |

OTHER PUBLICATIONS

Johnson U.S. patent application Ser. No. 171,909, filed Mar. 22, 1988, entitled "Electrical Connector".

*Primary Examiner*—William Briggs

[57] ABSTRACT

Electrical connector combination in which contact pins extending from separate portions of the connector hold a PCB by virtue of spring characteristics of the contact portions.

5 Claims, 1 Drawing Sheet

ELECTRICAL CONNECTOR

FIELD OF THE INVENTION

Figure 1:
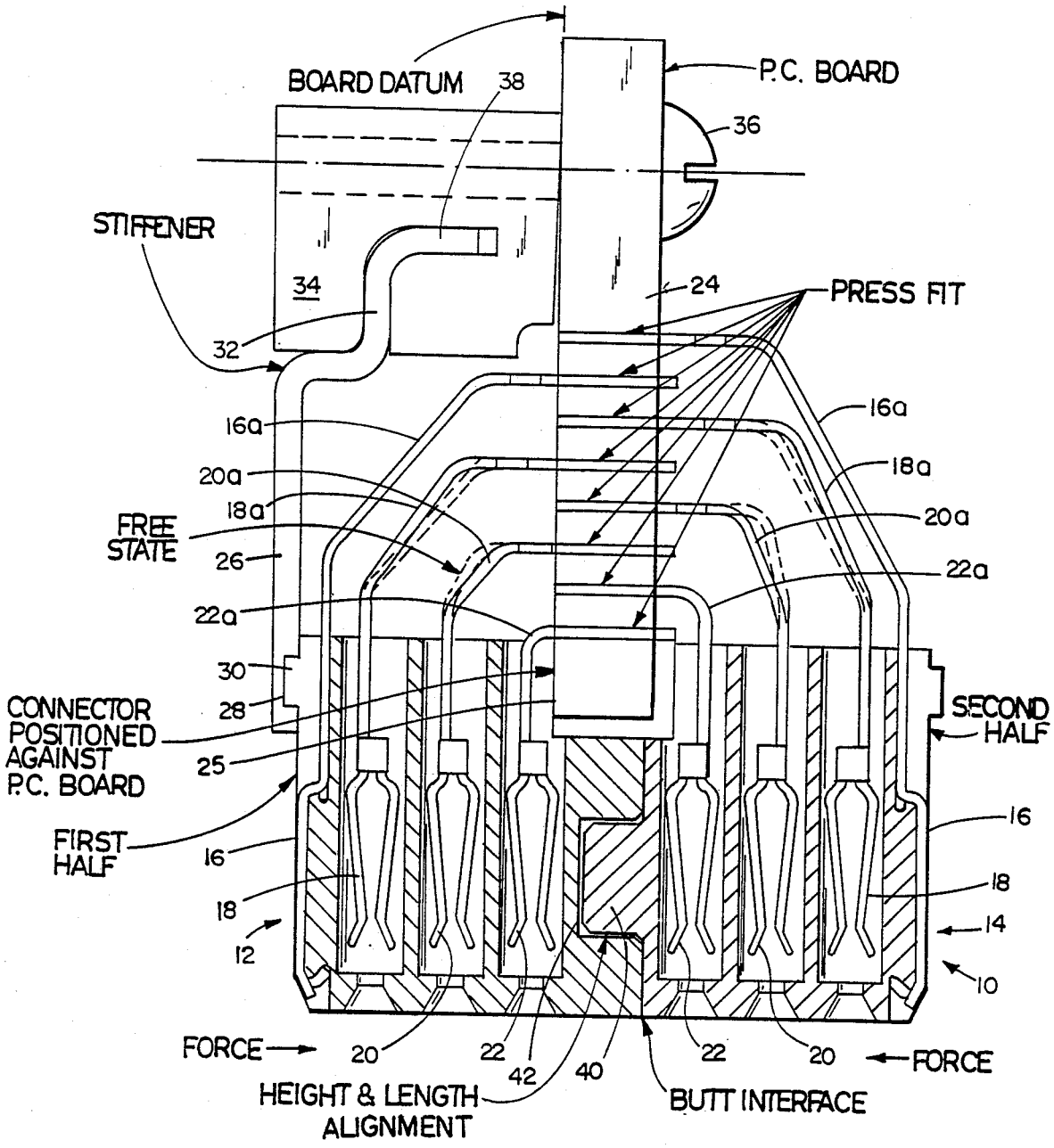

This invention relates to electrical connectors particularly useful in combination with daughter boards for connection with backplanes, and such combinations.

BACKGROUND OF THE INVENTION

Connectors for that purpose are known, as discussed in copending Lennart B. Johnson application Ser. No. 07/171,909, filed Mar. 22, 1988, "Electrical Connector", commonly owned herewith, and hereby incorporated herein by reference.

SUMMARY OF THE INVENTION

It has been discovered that portions of such a connector can be effectively assembled to such boards by using nothing more than spring forces in the contacts and alignment elements carried by the connector portions.

PREFERRED EMBODIMENT

The presently preferred embodiment is shown in the drawing, and then described.

DRAWING

The drawing is a transverse view, partially in section, through the printed circuit board with connector portions or halves mounted thereon.

DESCRIPTION

Connector 10 is made of a first half 12 and an identical plastic molded half 14, the two halves having reversed transverse and longitudinal orientation. Each connector half 12, 14 has mounted on or in it contact elements 16, 18, 20, 22, which terminate in upper portions 16*a*, 18*a*, 20*a*, and 22*a*.

Connector half 12, including its contacts, is first assembled to daughter board 24, abutment surface 25 thereof being pressed against daughter board 24 to provide a precise board datum.

In the process, the intermediate two of the upper contact ends, 18*a* and 20*a* are bent from their neutral position (in a springiness sense, the neutral position being shown in dotted lines in the FIGURE) to the positions shown in solid lines, in press-fitting them into board 24. The others, 16*a* and 22*a*, are press-fitted into the board 24 without imposing any such torque.

Stainless steel stiffener 26 is next assembled, and engages at groove 28 thereof longitudinal protuberance 30 of portion 12. Upper portion 32 of stiffener 26 is in longitudinally sliding relation with a corresponding slot extending longitudinally through plastic block 34, into which is secured self-threading screw 36, which holds block 34 and daughter board 24 together. The horizontal portion 38 of stiffener 26 extends before tightening of the screw 36 downwardly in the direction of the daughter board at an angle of 1°, so that on tightening of the screw 36 a force in the direction of the daughter board is imposed by stiffener 26 at protuberance 30. This also stiffens the spring array constituted by the contact portions 16*a*, 18*a*, 20*a*, and 22*a*.

Connector half 14 is then assembled to the daughter board 24, its contact portions 16*a*, 18*a*, 20*a*, and 22*a* being press-fitted thereinto. Again, the two intermediate tips, 18*a* and 20*a* are distorted in this step from their unstressed configurations shown in the dotted lines. In this assembly step, protuberance 40, toward one longitudinal end of half 14 is fitted into blind hole 42 correspondingly longitudinally located in half 12, while an identical protuberance toward the other longitudinal end of half 12 (not shown) fits into an identical blind hole (not shown) correspondingly toward the other longitudinal end of half 14. These mating blind holes with their surrounding abutting surfaces provide complete positional orientation between halves 12 and 14.

Each portion 12 and 14 is greater in length (i.e., the longitudinal direction) than width (that shown in the FIGURE), and includes a multiplicity of contacts including female portions in longitudinal rows. Stiffener 26 and daughter board 24 are secured to a plurality of connectors 10. Blocks 34 are short in the direction longitudinal of the daughter board, stiffener, and connectors 10, and are fewer in number than said connectors.

Connector 10 is suited to engage a backplane connector element as shown at 16 in said U.S. Pat. No. 4,655,518.

The deformation from the unstressed dotted line positions of contact portions 18*a* and 20*a* in half 12 tend to hold the daughter board 24 against movement, as does the deformation from the unstressed dotted line positions of contact portions 18*a* and 20*a* in half 14. The two deformed contact portions in each connector half exert oppositely directed forces on daughter board 24.

What is claimed is:

1. A PCB unit comprising
a board,
a first connector half, and
a second connector half,
each said connector half including a plurality of rows of contacts terminating in upper portions, the ends of said upper portions being pressfitted into said board,
at least certain of said upper portions having spring characteristics and being distorted to bias said board.

2. A unit as in claim 1 in which at least one said upper portion biases said board in a first direction, and at least one said upper portion biases said board in a second direction.

3. A unit as in claim 1 in which positioning means on the connector halves cooperate to position said halves relative to each other.

4. A unit as in claim 1 in which an abutment surface on one said half positions said board relative to said one said half.

5. A unit as in claims 1, 2, 3 or 4 in which one said upper portion on each said half biases said board in a first direction, and one said upper portion on each said half biases said board in an opposite direction.

* * * * *